US009651006B2

(12) United States Patent
Kilby et al.

(10) Patent No.: US 9,651,006 B2
(45) Date of Patent: May 16, 2017

(54) COMPONENT CATCH FOR CRASH ROBUSTNESS

(71) Applicant: Ford Global Technologies, LLC, Dearborn, MI (US)

(72) Inventors: John G. Kilby, New Boston, MI (US); George Louis Reno, IV, Farmington Hills, MI (US); Edward William Peters, Novi, MI (US); Narendra Desai, Plymouth, MI (US); Robert J. Forbes, Whitmore Lake, MI (US); Christopher Todd Snow, New Boston, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 112 days.

(21) Appl. No.: 14/635,983

(22) Filed: Mar. 2, 2015

(65) Prior Publication Data

US 2015/0167603 A1 Jun. 18, 2015

Related U.S. Application Data

(63) Continuation of application No. 13/907,581, filed on May 31, 2013, now Pat. No. 8,967,109.

(51) Int. Cl.
*F02M 35/16* (2006.01)
*F02M 35/10* (2006.01)
(Continued)

(52) U.S. Cl.
CPC ..... *F02M 35/161* (2013.01); *F02F 7/006* (2013.01); *F02M 35/104* (2013.01);
(Continued)

(58) Field of Classification Search
CPC ..... F02M 35/161; F02M 35/10078; F02M 2200/185; F02M 35/10144; F02M 35/104;
(Continued)

(56) References Cited

U.S. PATENT DOCUMENTS 3,516,704 A * 6/1970 Riester ..... B60N 2/20 180/286
4,734,113 A 3/1988 Takagi et al.
(Continued)

FOREIGN PATENT DOCUMENTS

EP 1447553 A2 8/2004

OTHER PUBLICATIONS

Anonymous, "Nircos Plastic Tank Structural Integrity Check," IPCOM No. 000241985, Published Jun. 11, 2015, 4 pages.

*Primary Examiner* — Long T Tran
(74) *Attorney, Agent, or Firm* — Julia Voutyras; McCoy Russell LLP

(57) ABSTRACT

Systems are disclosed to restrain movement of engine components in the event of a collision. A system may comprise an upper intake manifold; a cam cover; a shear catch located between the upper intake manifold and the cam cover; an upper component of the shear catch is arranged on the upper intake manifold; a lower component of the shear catch is arranged on the cam cover; and the upper component and the lower component are arranged opposite each other such that they engage when the upper intake manifold is subjected to shear forces. Variations to the size, arrangement, and shape of a shear catch are disclosed herein.

20 Claims, 5 Drawing Sheets

(51) Int. Cl.
*F02M 35/104* (2006.01)
*F02F 7/00* (2006.01)
*F02M 63/02* (2006.01)

(52) U.S. Cl.
CPC *F02M 35/10078* (2013.01); *F02M 35/10288* (2013.01); *F02M 63/0275* (2013.01)

(58) Field of Classification Search
CPC ..... F02M 63/0275; F02M 35/10085; F02M 35/10354; B29C 66/1312; B29C 66/301
USPC .... 123/184.21, 193.4, 195 R, 195 A, 195 H, 123/198 D
See application file for complete search history.

(56) References Cited

U.S. PATENT DOCUMENTS 4,901,681 A 2/1990 Pozniak et al.
4,970,994 A 11/1990 Sawada et al.
6,532,928 B2 3/2003 Ogata
6,776,132 B2 * 8/2004 Kudo ..... F02M 35/10111 123/184.42
6,868,818 B2 3/2005 Takahashi et al.
7,063,074 B2 * 6/2006 Horibe ..... F02M 35/10078 123/468
7,210,461 B2 5/2007 Schreeck et al.
7,357,110 B2 4/2008 Hashimoto et al.
7,819,104 B2 10/2010 Ito et al.
8,051,837 B2 11/2011 Choi
8,479,699 B2 7/2013 Ito et al.
2009/0145387 A1 * 6/2009 Takane ..... F01L 1/0532 123/90.33
2010/0139602 A1 * 6/2010 Choi ..... F02M 35/10052 123/184.47
2012/0247415 A1 * 10/2012 Kim ..... F02M 35/10216 123/184.21

* cited by examiner

COMPONENT CATCH FOR CRASH ROBUSTNESS

CROSS REFERENCE TO RELATED APPLICATIONS

The present application is a continuation of U.S. patent application Ser. No. 13/907,581, entitled "COMPONENT CATCH FOR CRASH ROBUSTNESS," filed on May 31, 2013, the entire contents of which are hereby incorporated by reference for all purposes.

TECHNICAL FIELD

The present application relates to restraint of engine component movement upon impact.

BACKGROUND AND SUMMARY

A vehicle intake system may comprise an upper intake manifold joined to a lower intake manifold. The upper intake manifold may be positioned over the cam cover. Fuel rails for supplying fuel to the respective cylinders may be mounted in front and in the rear of the joint between the upper intake manifold and the lower intake manifold. In the event of a collision, the upper intake manifold may be subjected to excessive shear forces, possibly resulting in shearing of the joint with the lower intake manifold.

Modifications to an intake manifold have been made to mitigate motion of the intake manifold during collisions. Previous approaches employ the addition of components to the top of the intake manifold to either increase structural rigidity, or to guide collision forces away from surrounding components. Other prior approaches employ added mounting hardware to strengthen the joint between the upper intake manifold and the lower intake manifold. These additional components or modifications to the manufacture of the intake manifold may increase production costs and/or overall weight of the engine.

Another approach to address collision forces utilizes a rigid body on the side of the intake manifold opposite the cam cover and cylinder head. The rigid body may guide collision forces in some collision scenarios, but does little in the event a shearing force is directed at the intake manifold. For example, a lateral force may be applied to the upper intake manifold and propagated along its length such that the upper intake manifold may be sheared at its attachment point to the lower intake manifold.

The inventors have recognized the above described issues and herein describe a potential solution. A shear catch is disclosed that employs components fitted underneath the intake manifold between the manifold and the cam cover. The shear catch comprises components that may reduce shear forces propagated along the length of the intake manifold that may potentially result in disengagement of the upper intake manifold from the lower intake manifold. In some embodiments, the shear catch comprises an upper component mounted to the underside of the upper intake manifold and a lower component mounted to the top side of the cam cover. The upper and lower components may engage in various ways, such as by snagging, hooking, interlocking, catching, deforming one another, among others. In this way, the technical effect of transferring load to intermediate components may be achieved.

In an embodiment, the shear catch may manage the deformation of intermediate parts to reduce impact and load transfer into components proximate to the manifold during impact events. In one example, this may be accomplished by adding structural features to the intermediate parts and a surrounding part (e.g. cam covers, lower intake manifold, cylinder head), that engage during the impact. These features cause deformation of the intermediate part, reducing load transfer and impact with surrounding components. In arranging the upper and lower components between the intake manifold and the cam cover there is clearance between the upper and lower components. This clearance may allow for ease of assembly, service, and for a decrease in noise, vibration, and harshness (NVH) characteristics. The location of a shear catch may also reduce the need for an additional crash bracket(s) or additional fastening location(s), thus reducing cost and weight. However, in other examples, additional structural features and components may be added to the intake manifold and/or cam cover in addition to a shear catch.

In an embodiment, systems are disclosed to restrain movement of engine components in the event of a collision. A system may comprise an upper intake manifold; a cam cover; a shear catch located between the upper intake manifold and the cam cover; an upper component of the shear catch is arranged on the upper intake manifold; a lower component of the shear catch is arranged on the cam cover; and the upper component and the lower component are arranged opposite each other such that they engage when the upper intake manifold is subjected to shear forces. Example variations to the size, arrangement, and shape of a shear catch are disclosed herein.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure. Further, the inventors herein have recognized the disadvantages noted herein, and do not admit them as known.

DETAILED DESCRIPTION

Various shear catch configurations are described herein. One example shear catch may be located between a cam cover and an intake manifold, and may include an upper and a lower component. An upper component may be bolted, molded or otherwise fastened to the underside of the intake manifold and a corresponding lower component may be likewise fastened to the upper side of the cam cover or other engine component. In some embodiments the upper and lower component may each comprise multiple pieces. For example, each upper component may have a corresponding lower component so as to form a plurality of matched component pairs. Alternately, a plurality of upper components may engage with a single elongated lower component, or a plurality of lower components may engage with a single elongated upper component. Furthermore, the upper or lower component may comprise an existing feature of the cam cover or upper intake manifold respectively. For example, an indent in the underside of the intake manifold may serve as an upper component to an added, attached lower component on the cam cover. In another embodiment, the shear catch may comprise a single element spanning the joint between the upper intake manifold and a lower intake manifold. In the event of a collision, the corresponding upper and lower components may engage, reducing shear forces applied to the intake manifold. This engagement of the components may manage the shear forces, allowing the intermediate components to crumple or contort and may reduce load transfer to nearby components.

Figure 1:
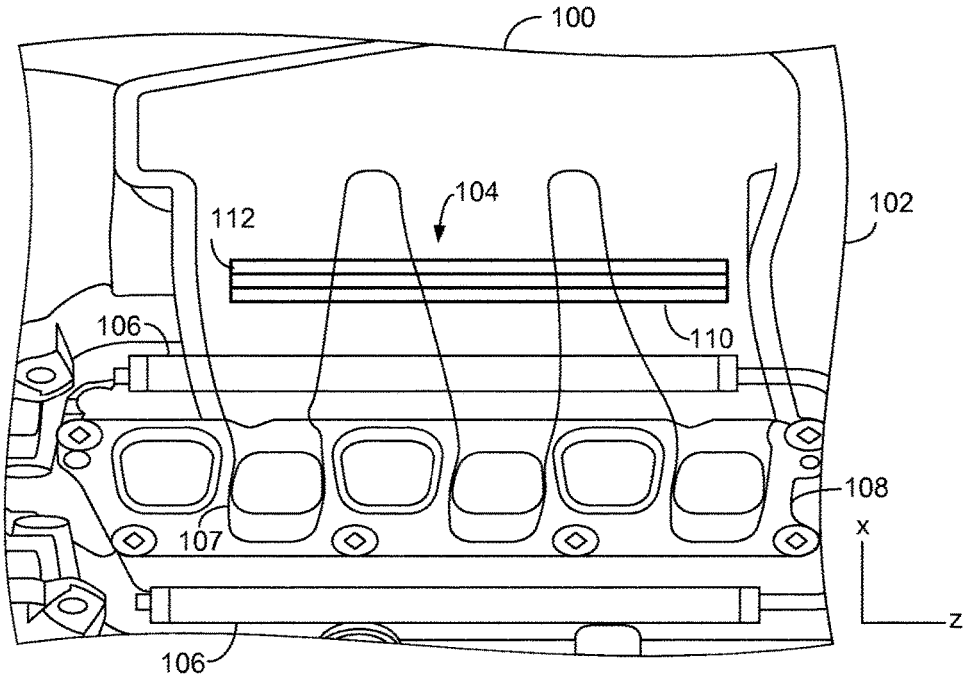
FIG. 1 shows an upper view of a segment of an intake manifold and engine with a first embodiment of a shear catch.
Figure 2:
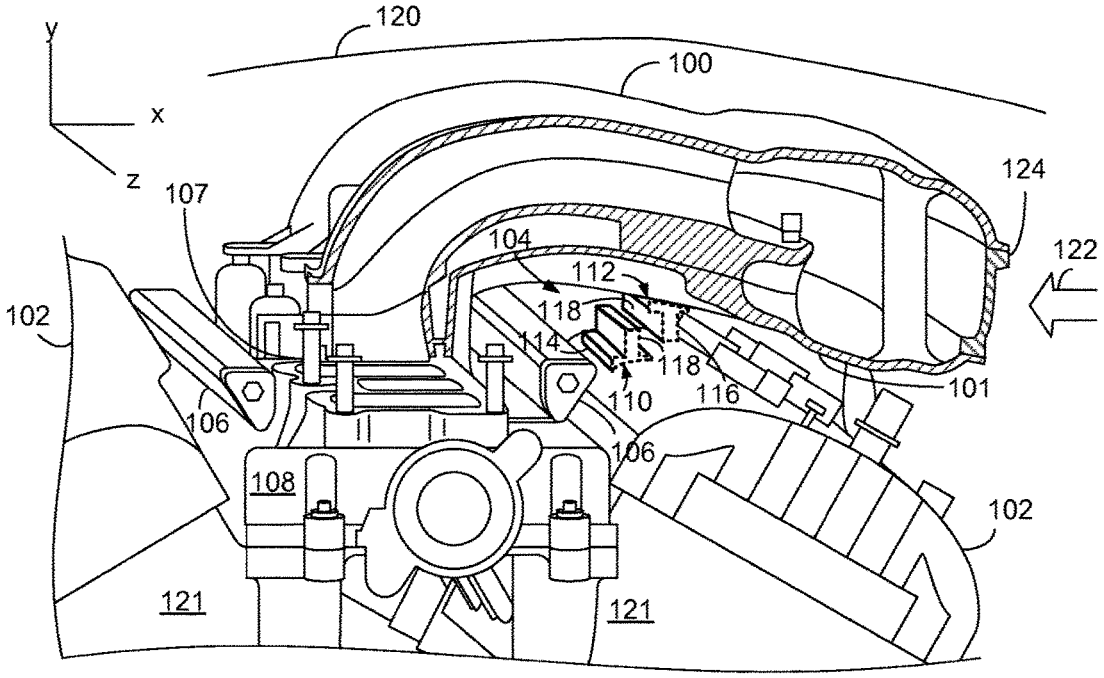
FIG. 2 shows a side view of the segment of the intake manifold and engine with the first embodiment of the shear catch.
Figure 3:
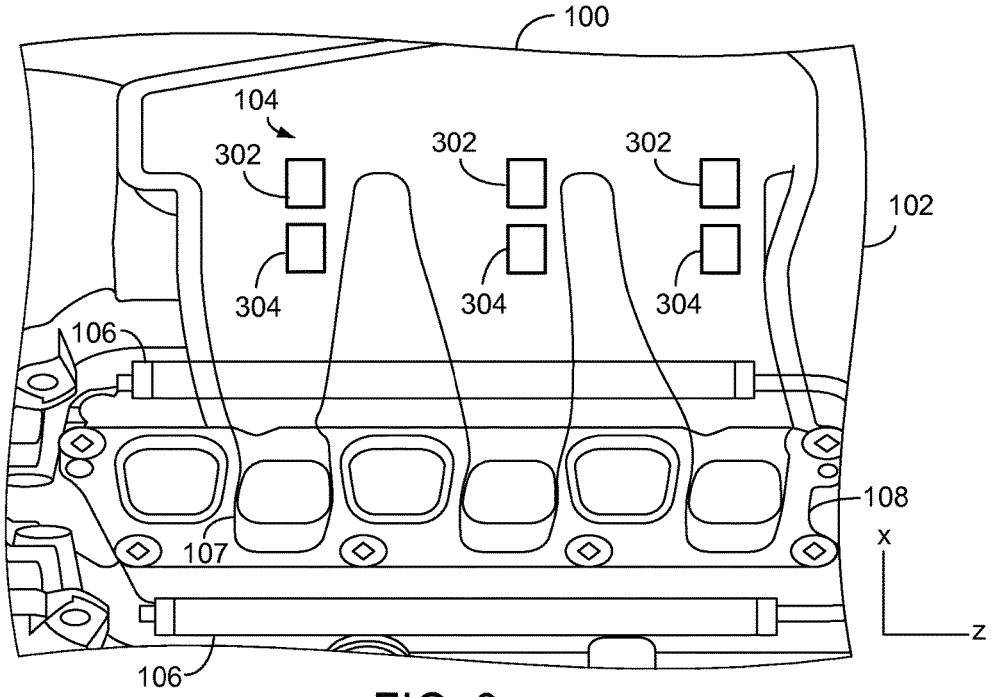
FIG. 3 shows an upper view of a segment of the intake manifold and engine with a second embodiment of a shear catch.
Figure 4:
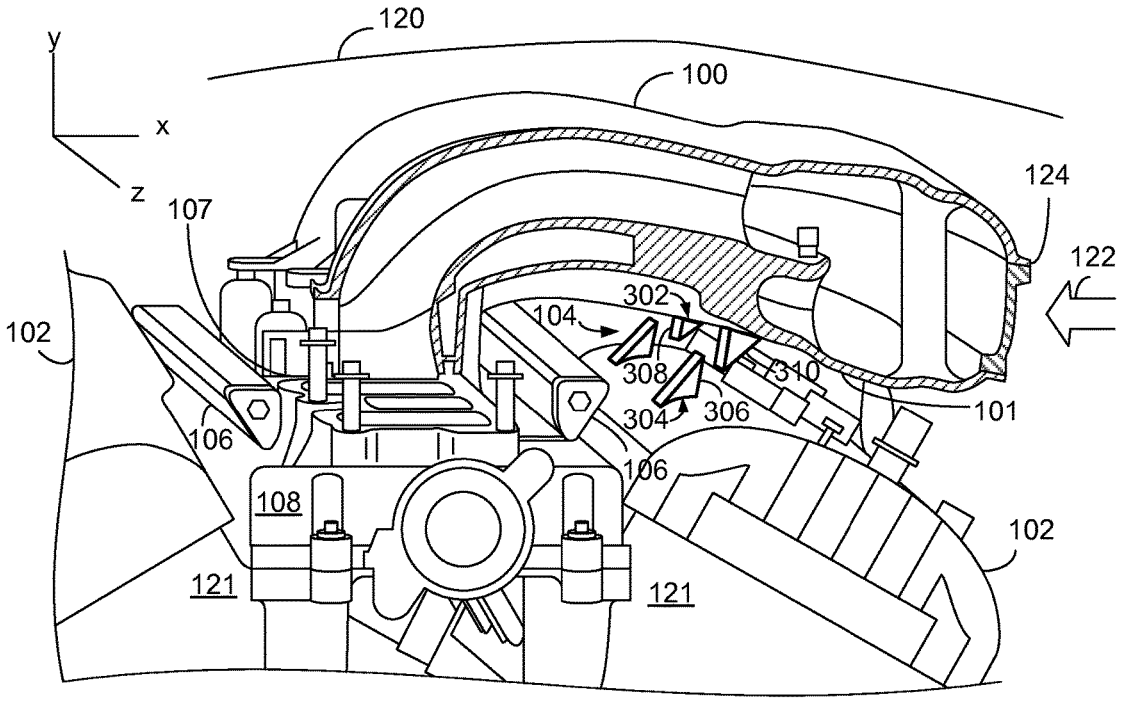
FIG. 4 shows a side view of the segment of the intake manifold and engine with the second embodiment of the shear catch.
Figure 5:
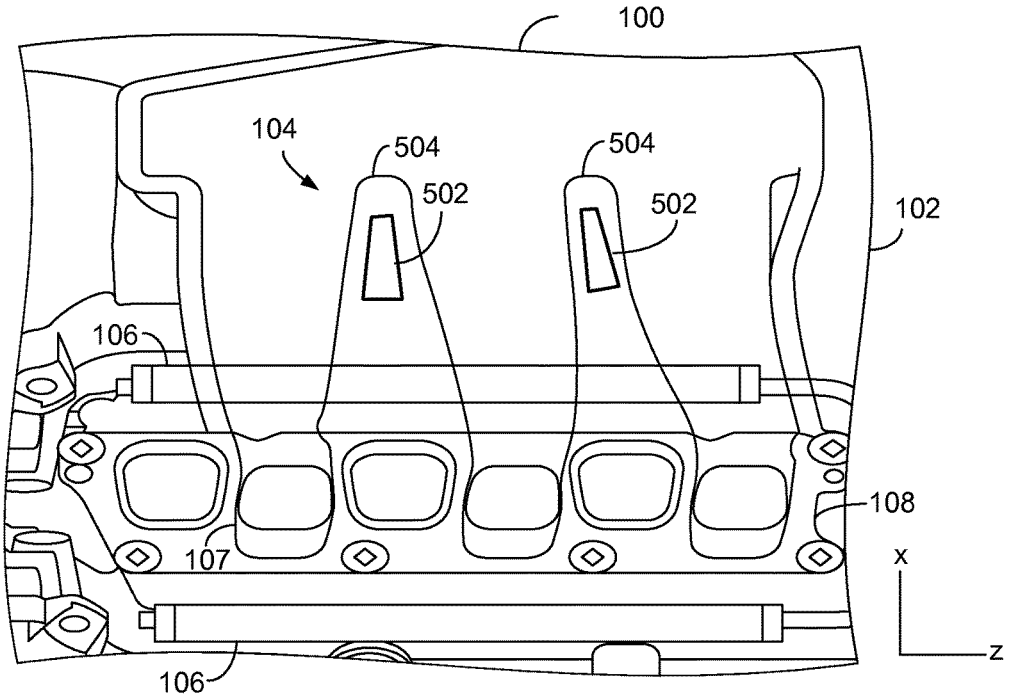
FIG. 5 shows an upper view of a segment of the intake manifold and engine with a third embodiment of a shear catch.
Figure 6:
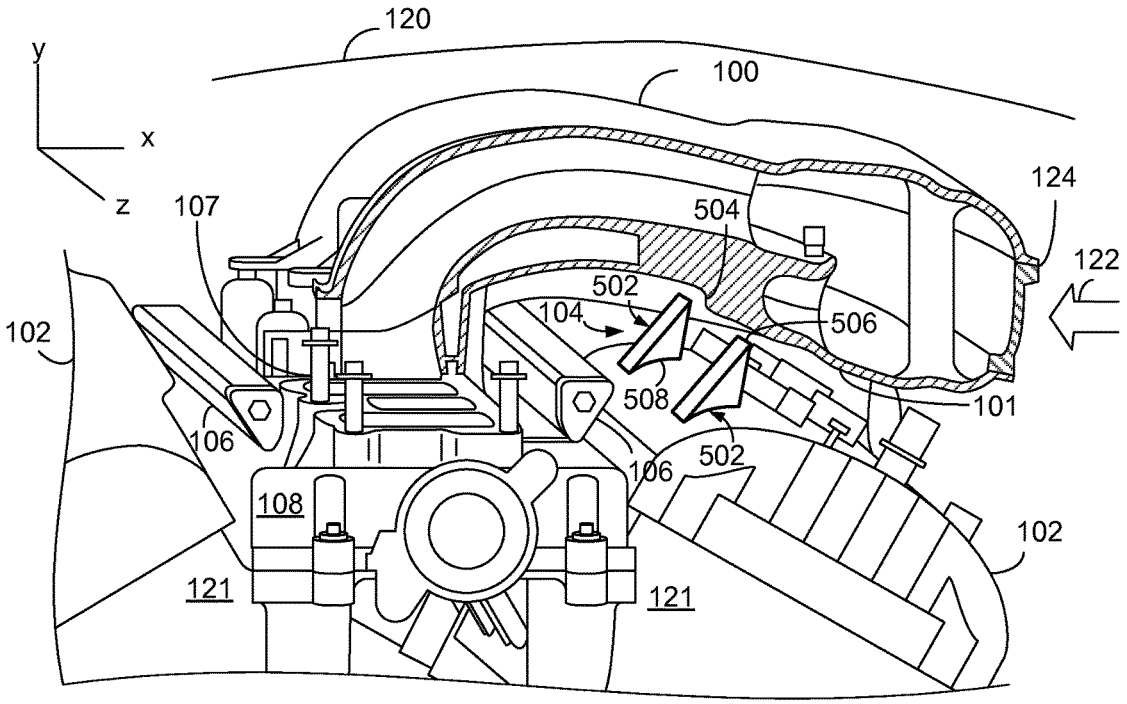
FIG. 6 shows a side view of the segment of the intake manifold and engine with the third embodiment of the shear catch.
Figure 7:
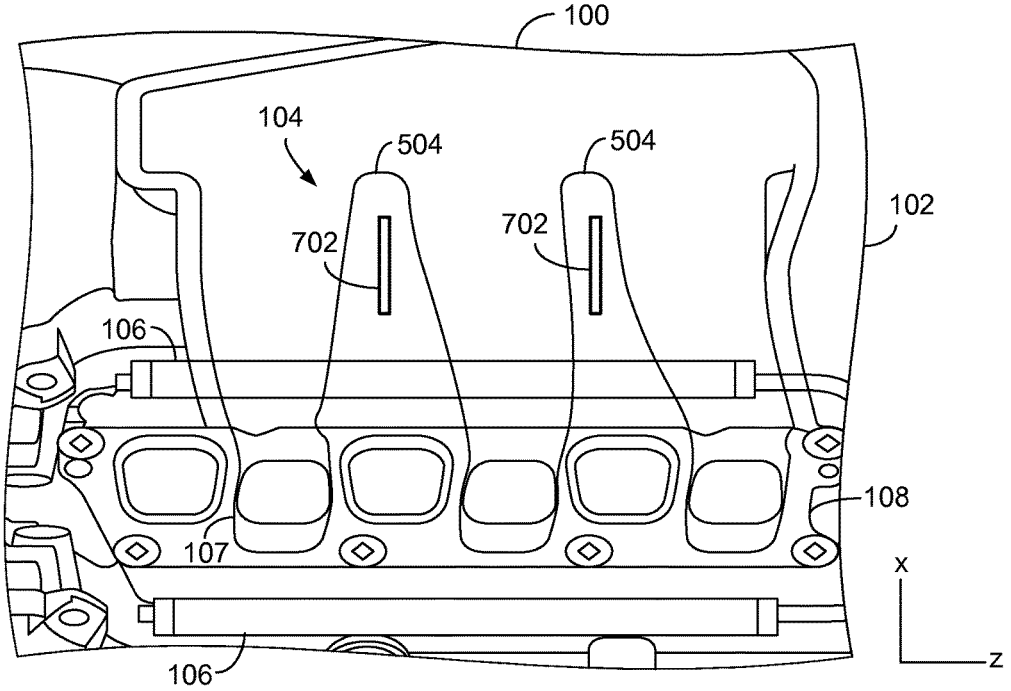
FIG. 7 shows an upper view of a segment of the intake manifold and engine with a fourth embodiment of a shear catch.
Figure 8:
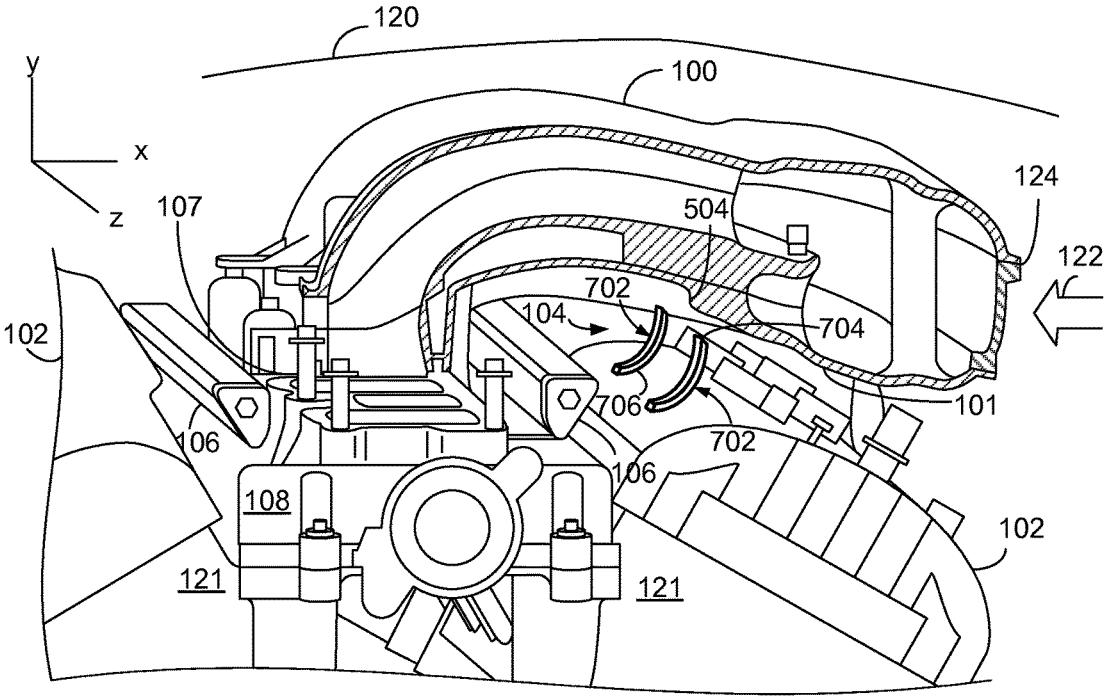
FIG. 8 shows a side view of the segment of the intake manifold and engine with the fourth embodiment of the shear catch.
Figure 9:
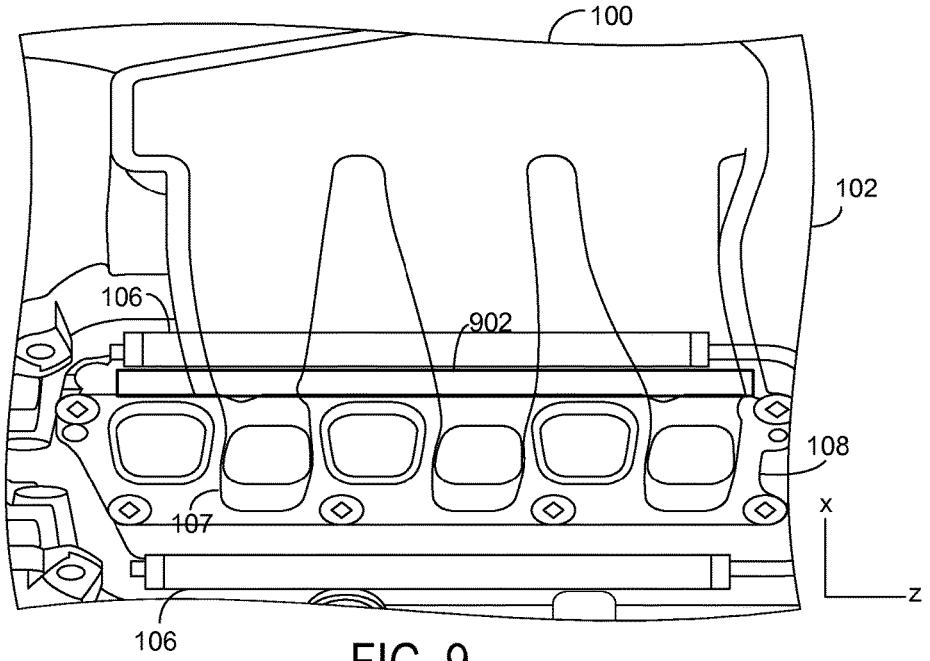
FIG. 9 shows an upper view of a segment of the intake manifold and engine with a fifth embodiment of a shear catch.
Figure 10:
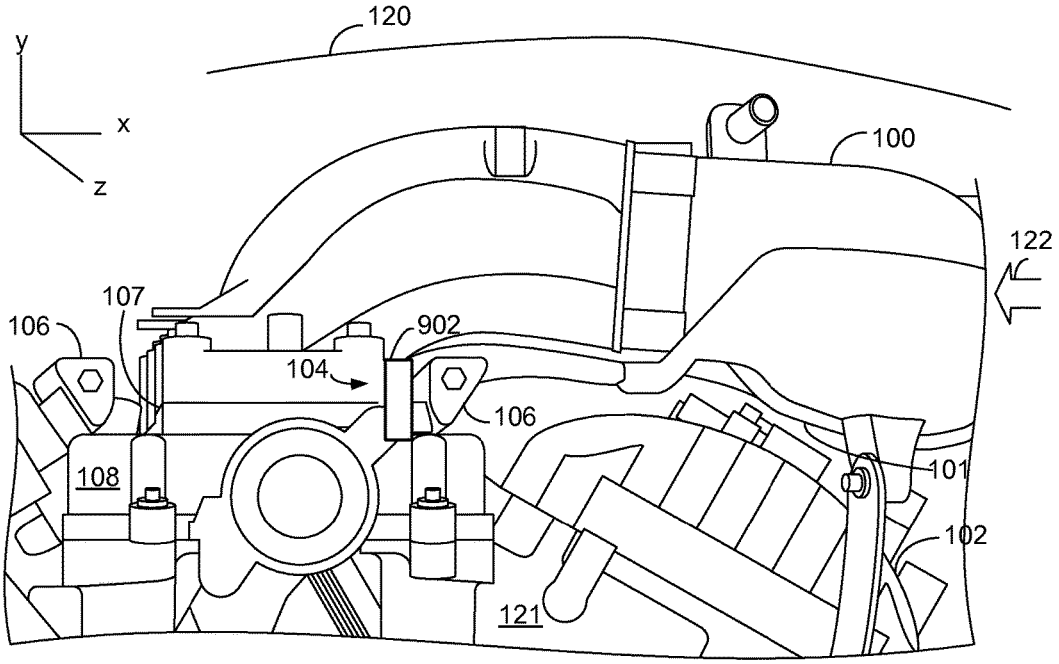
FIG. 10 shows a side view of the segment of the intake manifold and engine with the fifth embodiment of the shear catch.

Embodiments of the disclosure will be described in greater detail below in reference to the figures. FIGS. 1 and 2 show a first embodiment of a shear catch, where the shear catch is configured as a rail extending along the cam cover and intake manifold. FIGS. 3 and 4 show a second embodiment of the shear catch, where the shear catch comprises triangular components spaced apart along the length of the cam cover and upper intake manifold. FIGS. 5 and 6 show a third embodiment of the shear catch, where the shear catch comprises triangular components affixed to the cam cover aligned to catch intrinsic features of the upper intake manifold. FIGS. 7 and 8 show a fourth embodiment of the shear catch, where spikes are affixed to the cam cover to initiate fractures or ruptures in the upper intake manifold in the event of a collision. FIGS. 9 and 10 shows a fifth embodiment of the shear catch, where a lip is attached at the bottom surface of the upper intake manifold configured to prevent shearing of the upper intake manifold from the lower intake manifold.

Turning now to FIG. 1, a top view of a partial section of an engine is shown. Here, top should be understood to be in the direction of the intake manifold and bottom should be understood to be in the direction of the crankshaft, with respect to the engine block. In the examples depicted, top refers to the positive y direction and bottom refers to the negative y direction. It should be understood that, for the purposes of this disclosure, a lateral plane may refer to a plane that is substantially parallel to the x-z plane as depicted. In a vehicle embodiment, a lateral plane may be further parallel to an alignment plane of two front and two rear tires and/or a crankshaft. Note that in this example, the alignment of engine cylinders of a single cylinder bank runs in the z direction. In some embodiments, the front of the vehicle may be in the positive x direction and the rear of the vehicle in the positive y direction. In alternate embodiments, the front of the vehicle may be in a positive z direction and the rear of the vehicle may be in the negative z direction. For the purposes of this disclosure, a shearing force may be a force applied to the front/back of the vehicle or to the side of the vehicle, depending on engine alignment. Thus, a shearing force may be any lateral force in the x direction, or any force perpendicular to cylinder alignment and the length of a fuel line.

An intake manifold may comprise and upper intake manifold and a lower intake manifold. An upper intake manifold 100 may include a main intake passage that runs along a direction parallel to a crankshaft, i.e. in the z direction. The main intake passage may have an air charge inlet that is coupled to an intake system to receive air from the atmosphere. An intake system may comprise one or more charge air coolers or compressors. Downstream of the air charge inlet, the upper intake manifold 100 may branch from the main passage into one or more separate air passages. Each of the separate air passages may be coupled to an engine cylinder via a lower intake manifold. The upper intake manifold may be affixed to the lower intake manifold via an attachment joint 107. The lower intake manifold may have discrete air passages corresponding to the air passages in the upper intake manifold and/or the engine cylinders. An intake valve may be selectively actuated to fluidically couple a discrete air passage of the lower intake manifold to an engine cylinder. An exhaust system may similarly be selectively coupled to a cylinder via an exhaust valve.

A camshaft may be mechanically coupled to intake and exhaust valves that may be embodied as poppet valves. A camshaft may be coupled to each of the intake valves and exhaust valves of a cylinder bank. Other embodiments may have multiple camshafts actuating one or more valves of a cylinder bank. For example, a first camshaft may actuate the intake valves and a second camshaft may actuate the exhaust valves of a single cylinder bank. A camshaft may run along the length of the cylinder bank in the z direction and may have a number of lobes protruding radially and asymmetrically from the shaft. Each lobe may displace a shaft coupled to an intake or exhaust poppet valve as the shaft rotates. The camshaft may run along one or both sides of a cylinder bank and may be housed within a cam cover running along, and attached to, the cylinder head.

Fuel rails 106 may run parallel to the crankshaft on one or both sides of the intake manifold. Fuel rails 106 may run parallel to the mating plane of the upper and lower intake manifold. Further, fuel rails 106 may be slightly offset from, or may be longitudinally intersected by, the mating plane of upper intake manifold 100 and lower intake manifold 108. A fuel rail may couple a fuel tank to a fuel injector. A fuel injector may inject fuel into an engine cylinder or an exhaust system for combustion.

Upper intake manifold 100 is depicted in transparent form such that the cam cover 102 is visible beneath (the same is true in FIGS. 3, 5, 7, and 9). Additionally, a shear catch 104 is visible underneath the upper intake manifold 100, on top of the cam cover 102. Fuel rails 106 are located on either side of the attachment joint 107 of the upper intake manifold 100 and the lower intake manifold 108. Other fuel handling components may be located nearby the joint 107 of the upper intake manifold 100 and the lower intake manifold 108 including fuel injectors, pumps, lines etc.

FIG. 2 shows a second view of the first embodiment of the shear catch 104. The shear catch comprises an upper component 112, having a rib shape, which is affixed to the underside 101 of the upper intake manifold 100. The upper component 112 may be bolted or otherwise adhered to the upper intake manifold, or may be molded as a component of the upper intake manifold 100. A lower component 110, having a rib shape, is attached to the cam cover 102. The rib shape comprises a substantially linear upright lip 116, formed on a base structure 114 that may serve as a supportive flange capable of further dispersing shear forces, or may provide a surface with which to bolt or mold the upper and lower components to the upper intake manifold or cam cover respectively. The base structure may extend in the x-direction on either side of the upright portion of the rail shape. The base may also be molded or shaped such that it rests evenly on the cam cover or upper intake manifold by matching the intrinsic curvature or features therein.

Shear catch 104 and upper intake manifold 100 are shown in a cut away view in FIG. 2, but it should be understood that the upper component 112 and lower component 110 may extend the length of the cam cover 102 and the underside 101 of the upper intake manifold 100 so as to form a rib extending upward from the cam cover and downward from the upper intake manifold respectively.

In one example, a system comprises an intake manifold; a cam cover; and a shear catch. The cam cover may be mounted to a cylinder head of an engine. The intake manifold, optionally formed from an upper intake manifold and a lower intake manifold, may also be mounted to the cylinder head 121 and/or a cylinder block of the engine.

The catch may comprise two or more components separated from one another but at least partially aligned with one another longitudinally with respect to a vehicle in which the engine is positioned. The catch may comprise an upper component arranged on an external wall of the upper intake manifold on a side facing the cam cover; and a lower component arranged on the cam cover facing the upper intake manifold. The upper component may be more forward in the vehicle than the lower component, or vice versa. The upper component may be arranged so that it extends below the upper extent of the lower component. The upper component may be arranged in the same plane as the lower component but closer, in the x-direction, to the front of the vehicle (indicated at 122 in FIG. 2). The upper and lower components may be arranged opposite each other such that they engage when the intake manifold is subjected to excessive shear forces.

If the upper component is affixed to the upper intake manifold as shown, the lower component may be located between the upper component and the fuel rail. The upper component may protrude from the upper intake manifold 100 toward the cam shaft by a first amount and the lower component may protrude from the cam shaft toward the upper intake manifold by a second amount. The sum of the first amount and the second amount may be greater than a linear distance from the cam case to the upper intake manifold such that, if the intake manifold were laterally displaced in a direction toward the fuel line, the upper component would come into physical contact with the lower component.

The upper intake manifold 100 may be jointed to a lower intake manifold 108 via a joint 107, which may be a bolted joint. The lower intake manifold may be joined to the cylinder head 121 or engine block. The upper intake manifold may comprise two halves that are welded together at a seam 124. The seam may be a seam around an entire perimeter of the upper intake manifold, which may each be formed of plastic. The seam may be a sonic weld, in one example.

The system may further include a fuel rail 106. The fuel rail may be positioned proximate to the joint between the upper 100 and lower 108 intake manifolds. The fuel rail may be positioned on either side of the joint with respect to a longitudinal axis of the vehicle (the x-direction) in which the engine is mounted.

Under normal conditions, the upper and lower components are not in contact, but rather are spaced away from one another without any other components therebetween. The lack of contact between the two rib features of the shear catch may reduce NVH characteristics. However, during a crash, the intake manifold may make contact with the vehicle body and begin to deform or be pushed laterally (in the x-direction shown on the drawings) causing the upper component 112 to engage with the lower component 110 at the engaging surface 118. The engaging surface may be scored, etched, texturized or otherwise configured to aid engagement of the upper and lower components for the dispersion of excessive shear forces.

The upper and lower components may have various shapes. In one example, each of the components may have a face, each face facing each other without any other components therebetween. A space may be formed between the two faces. The upper and lower components may be formed by extended rails laterally positioned along the engine block. The extended rails may be positioned parallel to a crankshaft or row of cylinders of the engine block. The extended rails may extend along a full length of the cylinder block, intake manifold, and/or cam cover. In another example, the rails may not fully extend laterally along the engine. Further, the rails may be divided into separate sub sections or pairs of components, each pair longitudinally positioned opposite each other. The intake manifold may be positioned to extend from between first and second fuel rails, vertically and then longitudinally (in the x-direction) toward the front of the vehicle (indicated at 122).

When the shear catch is engaged, such as when a force is applied to vehicle body 120 it may be applied in the direction of arrow 122, from the front of the vehicle. Load transferred by the shear catch to the joint 107 between the upper intake manifold and lower intake manifold may be reduced, thus reducing joint failure. The shear catch may reduce this joint failure, possibly preventing the upper intake from breaking free, or transferring load to nearby components. The shear catch may help to restrain or manage movement of engine components upon impact.

Furthermore, a lower component may be bolted, molded, welded or otherwise affixed to the top of a cam cover. The cam cover may be attached on top of the cylinder head. The lower component may project upward from the cam cover in the y-direction shown in FIG. 2. The lower component may have a base structure that extends in the x direction along the cam cover to provide a surface for connecting the lower component to the cam cover. The base structure of the lower component may further provide a brace in the event the lower component comes in contact with the upper component in the event of a collision. The lower component may engage an upper component at matched, substantially planar surfaces. This engagement of the upper and lower component may serve to disperse shear forces pushing the upper intake manifold in the x direction. The engagement of the upper and lower component may further serve to disperse shear forces by initiating deformation, crumpling, rupturing or other contortion of the cam cover, upper intake manifold, or additional nearby components. Absorption or dispersion of applied force by the deformation of the intermediate components (e.g. upper intake manifold and cam cover) may serve to reduce movement of components within the engine space where they may become disconnected and potentially damage or interfere with other components.

Described here as a linear or rib shape, the shear catch of the present disclosure may take a variety of shapes, examples of which are described below with references to FIGS. 3-10. These other embodiments may assume different shapes or alignments and may comprise multiple match pairs of upper and lower components space apart on the intake manifold and cam cover respectively. It is further possible to combine embodiments of the shear catch. For example, a linear or rib shaped lower component such as 110 shown in FIG. 2 may be placed adjacent multiple standalone upper components, such as 302 of FIG. 4, that are spaced apart along the underside of the upper intake manifold. In another embodiment, an upper or a lower component may comprise existing structural features of an intermediate component. As an example, the upper intake manifold has on its underside curves or indents. This exterior curvature results from the air passages within the intake manifold as they feed into the various cylinders. These indents or recessed areas on the underside of the intake manifold may be suitable to serve as an upper component. A wall portion of the underside of the upper intake manifold may have an indented region with a substantially planar, vertical surface, extending toward the cam cover in the y direction. This substantially planar surface (for example, 504 of FIG. 6) may act as an engaging surface for the lower component mounted on the cam cover. The lower component may extend upward in the y-direction towards the underside of the intake manifold in an area opposite the intrinsic feature serving as the upper component at the upper intake manifold.

FIG. 2 depicts a v-style engine with a lower intake manifold arranged in the valley between two engine banks (shown at the top as cam covers 102). It should be appreciated that the object of the present disclosure is suitable for any type or style of engine and may be adapted to, for example, a V-6, I-4, I-6, V-12, opposed 4, or other engine type so long as the shear catch may be arranged to manage excessive shear forces that the upper intake manifold may be subjected to. Furthermore, the shear catch of the present disclosure is suitable to be adapted to known engines without redesign of existing cam covers or intake manifolds. The upper and lower components may be bolted on to the upper intake manifold or cam cover post component production or during engine assembly. However, it is also possible to design a cam cover or intake manifold incorporating a shear catch such that components may be molded into the cam cover or upper intake manifold, for example.

In an embodiment wherein the upper and lower components are fastened to an intake manifold and/or cam cover, the catch component may have a variety of shapes. For example, the catch component may have a 'T' shape cross section wherein the upper part of the T forms an attachment surface that may mounted in a direction substantially parallel to the cam cover or intake manifold. The upper portion of the T shape may be welded or bolted so it is flush with the surface of the cam cover or intake manifold. The bottom of the T shape may thus protrude perpendicularly from the cam cover toward the intake manifold and vice-versa.

Turning now to FIGS. 3 and 4 a second embodiment of a shear catch is shown. In the second embodiment, the shear catch 104 comprises multiple upper components 302, having a triangular shape, and lower components 304, having a triangular shape, arranged along the length of the underside 101 of the upper intake manifold 100 and cam cover 102 respectively. As seen in FIG. 3 the shear catch 104 components may be spaced out along the length of the cam cover or upper intake manifold so long as the upper component 302 and lower component 304 are opposite from one another so that they may engage in the event of a collision. The triangular shape may serve as a brace when the upper and lower components engage.

The upper and lower components may have a substantially right triangle shape, wherein a first side may be one side of the triangle adjacent to the substantially right angle. The first side may be flesh with the surface of the cam cover or upper intake manifold. The second side may be the other side of the triangle adjacent to the substantially right angle. The second side may face the opposite component such that the hypotenuse faces away from the opposite component. For example, the first side of a lower component may be flesh with, and attached to, the cam cover; the second side of the lower component may face away from the fuel line such that the hypotenuse faces the fuel line. Further, the first side of an upper component may be attached to, and flesh with, the intake manifold; the second side of the upper component may face toward the lower component and fuel line such that the hypotenuse faces away from the fuel line. The sum of the length of the second side of the upper component and the second side of the lower component may be greater than a linear distance between the intake manifold and the cam cover. Thus, if the intake manifold is laterally displaced in the direction toward the fuel line, the upper component and the lower component will come into physical contact.

In FIG. 4, two matched pairs of upper component 302 and lower component 304 are shown along the length of the engine for the sake of simplicity of the drawings. The engaging surface of the upper component 308 and the engaging surface of the lower component 306 are positioned opposite each other but do not touch under normal circumstances. Upon impact, an excessive shear force may be applied to the upper intake manifold 100 resulting in the engaging surfaces 306 and 308 contacting. The triangular shape of the shear catch of the second embodiment may function as a brace, transferring shear forces through the extending portion 310 to the cam cover or underside 101 of the upper intake manifold 100.

It should be appreciated that more matched pairs may be affixed to the cam cover and upper intake manifold. Furthermore, the size of each component of shear catch 104 may vary. Though depicted here as triangles, the upper catch and lower catch may comprise, rectangular, square, hooked or other shapes as long as they are suitable to engage and absorb or transfer forces in the event of a collision. Furthermore, each catch component may be designed to puncture, rupture or otherwise deform an intermediate component (e.g. the upper intake manifold) so as to manage component failure.

Turning now to FIGS. 5 and 6, a third embodiment of a shear catch 104 in accordance with the present disclosure is shown. In this third embodiment the lower component 502 is shown molded, bolted, bonded or otherwise affixed to the cam cover. The engaging upper component 504 may be intrinsic to the upper intake manifold 100. The engaging upper component 504 may be form by a manifold indent, where the contouring of the underside 101 of upper intake manifold 100 forms a lip or concavity suitable to engage with the lower component in the event of a collision when an upper intake manifold may be subjected to shear forces.

As above, the shape and number of the upper and lower components may vary. Furthermore, each pair of upper and lower components need not be identical in shape, size, or alignment and may be individually contoured to best fit a specific engine, or aligned to most effectively disperse shear forces. As with any shear catch of the present disclosure the lower component 502 of the third embodiment may also be designed so as to puncture intermediate engine components if beneficial for preventing the movement and transfer of load of engine components upon impact. For example tip 506 of the lower component 502 may be pointed, sharpened, serrated, reinforced or otherwise equipped to puncture the underside 101 of the upper intake manifold 100. As with the second embodiment of shear catch 104, as shown in FIGS. 3 and 4, the triangular shape may function as a brace against shear forces. Furthermore, the base 508 of the lower component 502 may be shaped or formed so as to fit on the cam cover 102. The lower component may project into a lateral plane (parallel to the x-z plane) that intersects the intake manifold such that lateral displacement of the intake manifold toward the fuel rail would force the intake manifold into physical contact with the lower component at one or more locations.

In reference to FIGS. 7 and 8 a fourth embodiment of the shear catch 104 is shown. In the fourth embodiment a lower component 702 is attached to the cam cover 102 and extends toward the underside 101 of the upper intake manifold 100. As seen from a side view in FIG. 8, the lower components 702 may be hook or spiked shaped. The shape, size, and orientation of the lower spike component may be optimized to induce fractures into an intermediate component, namely the upper intake manifold such that component failure may be managed. For example tip 704 of the lower component 702 may be pointed, sharpened, serrated, reinforced or otherwise equipped to puncture the underside 101 of the upper intake manifold 100.

In the context of a spike shaped lower component 702, features of the upper intake manifold may again serve as the upper component 504. These features may be a manifold indent or lip as describe above in reference to FIGS. 5 and 6 but may be any surface of the upper intake manifold which is suitable to rupture or puncture when engaged with the lower component 702. Furthermore, the lower component 702 may be bolted to the cam cover at its base 706. In other examples, the base of a spike shaped lower component may comprise a different, or broadened shape that may more easily accommodate bolting or welding to the cam cover. In yet another example, the base 706 may be encompassed by a bracket with a face adjacent to the cam cover and configured to hold the lower component to the cam cover.

Turning now to FIGS. 9 and 10, a fifth embodiment of the shear catch 104 is shown. This embodiment of the shear catch comprises a single lip 902 molded at the edge of the bottom surface of the upper intake manifold 100 to prevent shearing from the lower intake manifold 108. The lip is arranged at the joint 107 between the upper intake manifold and the lower intake manifold to protect the joint 107 when the upper intake manifold is subjected to excessive shear forces. The lip is further arranged between a fuel rail and the joint between the upper intake manifold and the lower intake manifold. The lip 902 may be configured as a rib, beam, or other rigid feature. The lip 902 may extend the length of the intake manifold and/or cam cover (as seen in FIG. 9). The lip may be integral to the upper intake manifold 100, or molded, bolted, or otherwise attached to the base of the upper intake manifold. The lip may further be bolted to the lower intake manifold 108. The lip 902 may comprise a metal alloy or any suitable rigid material. The lip 902 of the fifth embodiment may further be combined with other embodiments of the shear catch 104 pictured in FIGS. 1-8.

Systems are disclosed to restrain movement of engine components in the event of a collision. A system may comprise an upper intake manifold; a cam cover; a shear catch located between the upper intake manifold and the cam cover; an upper component of the shear catch is arranged on the upper intake manifold; a lower component of the shear catch is arranged on the cam cover; and the upper component and the lower component are arranged opposite each other such that they engage when the upper intake manifold is subjected to shear forces. Variations to the size, arrangement, and shape of a shear catch are disclosed herein.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system, comprising:

an upper intake manifold;

a cam cover; and a shear catch, comprising:

an upper component having a triangular shape at the upper intake manifold on a side facing the cam cover with a substantially planar, vertical surface; and a lower component having a triangular shape extending up from the cam cover facing the upper intake manifold;

the upper and lower components arranged opposite each other and configured to engage when the upper intake manifold is subjected to excessive shear forces and wherein the upper and lower components comprise multiple pieces arranged as matched pairs.

2. The system of claim 1, wherein the lower component is configured to engage the upper component when the upper intake manifold is subjected to excessive shear forces.

3. The system of claim 1, wherein the lower component is bolted to the cam cover and the upper component is bolted to the upper intake manifold.

4. The system of claim 1, wherein the upper and lower components do not engage under normal conditions.

5. A system, comprising:

an upper intake manifold;

a cam cover; and a shear catch, comprising:

an upper component at the upper intake manifold on a side facing the cam cover with a substantially planar, vertical surface; and a lower component extending up from the cam cover facing the upper intake manifold;

the upper and lower components arranged opposite each other and configured to engage when the upper intake manifold is subjected to excessive shear forces and the lower component has a rib shape comprising a substantially linear upright lip, formed on a base structure that serves as a supportive flange capable of further dispersing shear forces.

6. The system of claim 5, wherein the lower component is located between the upper component and a fuel rail.

7. The system of claim 6, wherein the upper component protrudes from the upper intake manifold toward the cam shaft by a first amount and the lower component protrudes from the cam shaft toward the upper intake manifold by a second amount.

8. The system of claim 7, wherein a sum of the first amount and the second amount is greater than a linear distance from the cam cover to the upper intake manifold.

9. The system of claim 5, wherein the lower component is bolted to the cam cover and the upper component is bolted to the upper intake manifold.

10. The system of claim 5, wherein the upper and lower components extend along the upper intake manifold and a lower intake manifold respectively.

11. The system of claim 5, wherein the upper and lower components do not engage under normal conditions.

12. The system of claim 5, wherein the lip is arranged at a joint between the upper intake manifold and a lower intake manifold to strengthen the joint when the upper intake manifold is subjected to excessive shear forces.

13. The system of claim 12, wherein the lip extends a full length of the joint between the upper intake manifold and the lower intake manifold.

14. The system of claim 12, wherein the lip is bolted to the upper intake manifold and the lower intake manifold.

15. The system of claim 12, wherein the lip is further arranged between a fuel rail and the joint between the upper intake manifold and the lower intake manifold.

16. A system, comprising:

an upper component attached to an upper intake manifold; and a lower component attached to a cam cover;

the upper component and lower component spaced away from each other and configured to engage when the upper intake manifold is subjected to excessive shear forces.

17. The system of claim 16, wherein the upper component and the lower component are bolted to the upper intake manifold and the cam cover respectively.

18. The system of claim 16, wherein the upper and lower components comprise multiple pieces arranged as matched pairs.

19. The system of claim 16, wherein the lower component is shaped to rupture the upper intake manifold when the upper intake manifold is subjected to excessive shear forces.

20. The system of claim 16, wherein the upper component extends a full length of the upper intake manifold and the lower component extends a full length of the cam cover.

* * * * *